United States Patent [19]

Cryctko

[11] 3,940,838

[45] Mar. 2, 1976

[54] CRIMPING TOOL FOR CABLE CONNECTOR

[75] Inventor: Carl E. Gryctko, Haddon Heights, N.J.

[73] Assignee: I-T-E Imperial Corporation, Spring House, Pa.

[22] Filed: Feb. 24, 1975

[21] Appl. No.: 552,202

[52] U.S. Cl. ..... 29/203 DT; 29/203 HT; 29/461; 29/628; 72/410; 72/454

[51] Int. Cl.[2] ..... H01R 43/04

[58] Field of Search ..... 29/203 DT, 203 D, 203 HT, 29/203 H, 628, 461; 72/410, 454, DIG. 1; 140/121

[56] References Cited

UNITED STATES PATENTS

| | | | |
|---|---|---|---|
| 1,677,968 | 7/1928 | Hughes | 29/203 DT |
| 2,247,041 | 6/1941 | Bergan | 29/461 |
| 3,800,584 | 4/1974 | Edwards, Sr. et al. | 29/203 H |

*Primary Examiner*—Carl E. Hall

*Attorney, Agent, or Firm*—Ostrolenk, Faber, Gerb & Soffen

[57] ABSTRACT

A crimping tool for use with a stranded cable connector having co-aligned sleeve openings, including a first member with a crimping portion; a piercing portion extended from the first crimping portion; a second member with a crimping portion and a recess for receiving the piercing portion and means to move the first and second crimping portions towards one another. A loose fitting cable connector sleeve with an inserted cable portion is positioned on the second crimping portion and the piercing portion is moved through the sleeve openings, thereby displacing the cable strands toward the interior wall of the sleeve, and forming a through passage. Movement of the cooperating crimping portions continues until the crimping portions have formed flat surface areas along the entire length of the sleeve thereupon and further movement is limited by an adjustable stop.

14 Claims, 7 Drawing Figures

FIG. 1
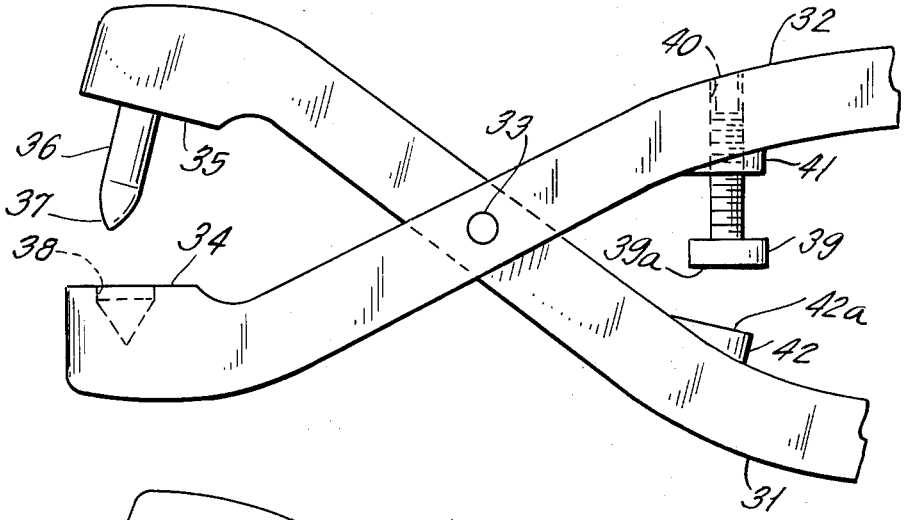
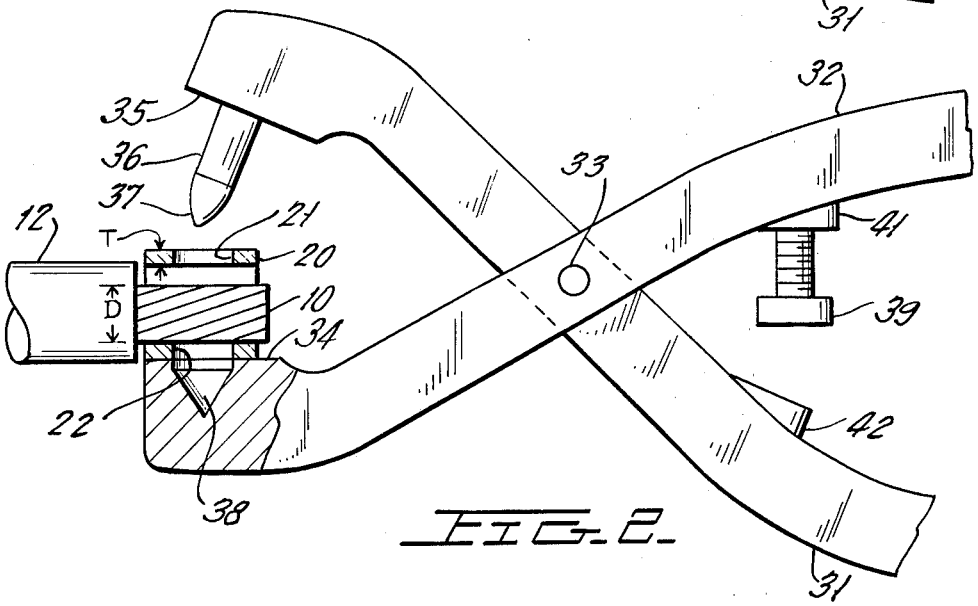
FIG. 2
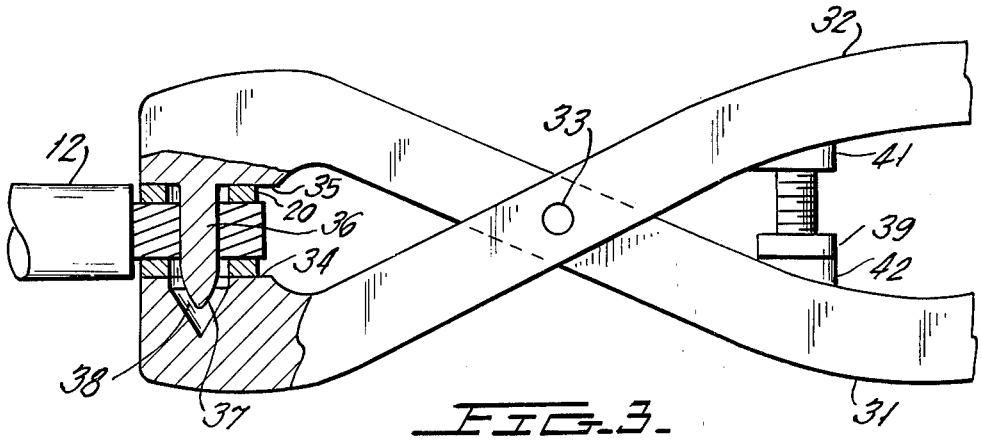
FIG. 3

CRIMPING TOOL FOR CABLE CONNECTOR

BACKGROUND OF THE INVENTION

This invention relates to crimping apparatus and more particularly relates to a tool of this type for crimping a connector sleeve to a stranded cable.

Generally, a crimping tool must be capable of exerting sufficient pressure on several surfaces of a connector sleeve to cause the sleeve walls to be deformed so as to engage and frictionally hold the stripped portion of a cable which has been positioned within the sleeve bore. A crimping tool must not exert pressures in excess of this captivating pressure, since overpressurization often results in both cable strand breakage and connector sleeve splitting, which render the crimped connector useless for its intended purpose.

The crimping tool may also be required to perform other functions ancillary to the crimping process. These functions may include the forming of mounting or bearing surfaces on the sleeve, the forming of the entire connector into a shape as required by mounting volume considerations, the forming of apertures for the passage of mounting hardware through the sleeve or the sleeve and cable, the preventing of the application of excessive force in order to minimize distortion of a pre-formed sleeve portion or surface or the maintaining of a particular shaped surface or section while pressure is applied to adjacent surfaces or sections.

The crimping tool may, additionally, be required to establish and hold the connector sleeve and cable in a rigid relationship to one another and to the crimping tool. This positioning apparatus complicates the crimping tool and a preferred tool should be operable without elements utilized solely for holding the connector sleeve and the cable.

Crimp-type connectors have been formed with a flat portion having a through aperture, to allow passage of mounting hardware, and a tube, with its axis displaced above the plane of the flat portion, into which a cable end is placed. This offset tube is then crimped to the cable end by a tool which applies opposed forces of a magnitude sufficient to press the inner wall of the tube into intimate engagement with the cable strands. Large and often abrupt forces are generated by the crimping tool and the cable strands are often deformed and even nicked or severed by the crimping operation. The crimping tool must be designed to prevent contact with the flat portion of the connector during the crimping operation or the large forces exerted during crimping will be transmitted to that portion and will distort the mounting hardware aperture and the flat contact surface to such an extent that the crimped connector cannot be used at the intended connection surface.

Other crimp-type connectors have been formed by crimping a portion of tube to a cable end and then shearing the mounting hardware passage through the crimped tube and cable in a single operation of the crimping tool. Shearing a cylindrical tube containing a cable causes strands to have less high-pressure contact with the entire tube interior and results in unsatisfactory electrical contact between cable and mounting surface. The force necessary to shear the tube and the cable is usually obtained from explosive expansion, requiring that a relatively complex and massive tool be used and necessitating that the tool hold both tube and cable firmly in position so as not to be prematurely ejected from the tool and thereby create a hazardous condition.

A more compact and conductive connector is formed by inserting a cable end into a sleeve having co-aligned apertures. A passage is formed by displacing the cable strands from the region defined by a line extending between the two apertures. As the cable strands are displaced and the apertures in the wall of the sleeve have been previously formed, no shearing operation is necessary. The sleeve may now be crimped to the formed cable by the application of opposed forces along the entire exterior length of the sleeve, resulting in a high conductivity electrical connection. The need for abruptly generated forces is eliminated and relatively slow and steady engagement of the crimping tool may be utilized. It is desirable that the piercing portion of the tool remain within the passage formed in the cable during the crimping operation so that the passage shape is not altered. Because of the requirement for maintaining the position of the piercing portion, the crimping tool must be constructed in such a manner that the portions of the tool exerting the crimping force are unaffected by the piercing portion, to prevent the formation of a loose contact between the connector sleeve and the cable strands in the immediate vicinity of the mounting hardware passage. This is exactly that region of the connector at which firm contact is desired so as to provide the shortest and, therefore, the lowest electrical resistance path from the cable through the connector sleeve to the terminal to which the connector is to be mounted. The proper crimping tool for a connector of this type must provide this crimping pressure in the region immediately adjacent to the aperture while forming as large a crimped surface as possible for contact with the mounting surface and also preventing the collapse or return movement of the cable strands into the mounting hardware passage.

SUMMARY OF THE INVENTION

A crimping tool for the above described type of connector is described hereinafter.

To provide the necessary piercing of the cable and the necessary crimping pressure upon the connector sleeve while maintaining the integrity of the mounting hardware passage and preventing the application of excessive crimping pressures to the connector sleeve, the crimping tool in accordance with the invention has a piercing portion extended from the crimping portion of a first member which can be moved towards the crimping portion of a second member. The crimping portion of the second member is provided with a recess to receive the piercing portion of the first member such that the members may continue to come together until the opposing crimping portions have moved to a position which produces the required crimping pressure upon the sleeve of a stranded cable connector inserted between the two opposed crimping portions. An adjustable stop is provided in one member to bear against a buttress portion on the other member, thereby limiting the minimum distance between the crimping portions of the first and second members. The crimping tool is also provided with means for indicating the magnitude of crimping force produced on the connector sleeve.

The novel crimping tool set forth hereinabove has the advantage that it permits the piercing portion to form and maintain the mounting hardware through-passage while the crimping portions apply the pressure necessary to press the sleeve wall against the cable, forming flat portions for connector contact over the entire length of the sleeve surface including that area immediately adjacent to the mounting hardware through-passage. The crimping tool is easy to manufacture and does not require complex or massive components.

Accordingly, it is the primary object of the present invention to provide a novel crimping tool for forming stranded cable connections.

Another object of the present invention is to provide a crimping tool of the type described herein which is compact, yet embodies all the desirable mechanical features required for crimping a stranded cable connector.

A further object is to provide a crimping tool of the type described characterized by its ease of manufacture at low cost and the simplified crimping operation resulting from the use of the tool.

These and other objects of this invention will become apparent from the following description of the accompanying drawings.

BRIEF DESCRIPTION OF THE DRAWINGS

FIG. 1 is a side elevation of a crimping tool in accordance with the teachings of the instant invention;

FIG. 2 is a partially-sectionalized view in side elevation of the crimping tool in the open position and embodying the teachings of the invention and further showing a connector sleeve and stranded cable in the positions occupied preparatory to the passage forming and crimping operations;

FIG. 3 is a partially-sectionalized view in side elevation of the crimping tool of FIG. 2 in the closed position and further showing the completed stranded cable connector formed by the tool;

DETAILED DESCRIPTION OF THE INVENTION

Figure 7:
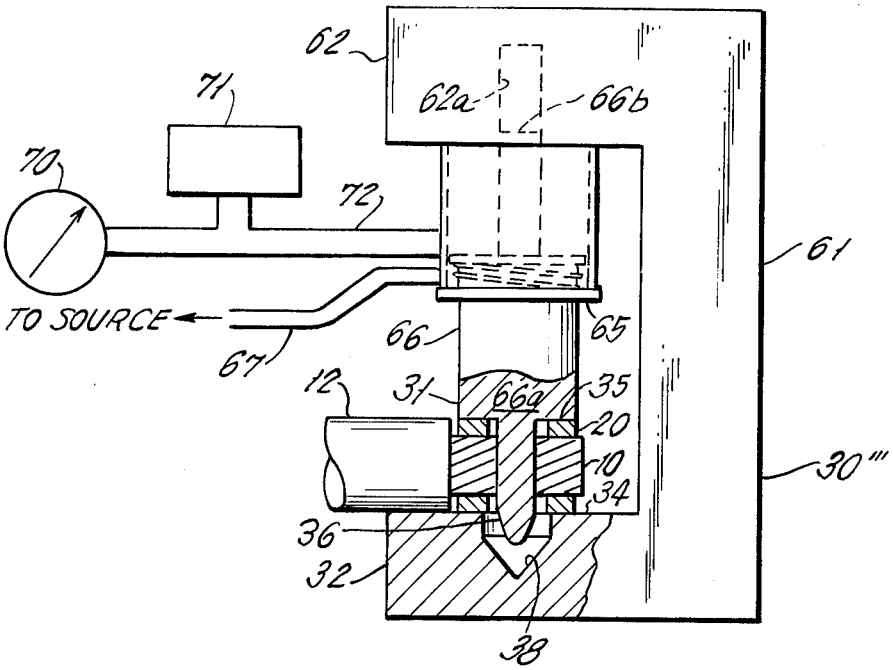
FIGS. 5, 6 and 7 are side elevations of alternate embodiments incorporating the teachings of the invention.
Figure 4:
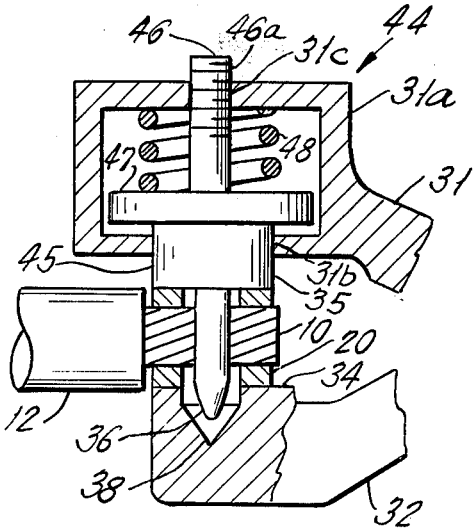
FIG. 4 is a partially-sectionalized view in side elevation of a portion of a crimping tool in accordance with the invention and showing one embodiment of a force measurement device used therewith.

Referring to FIG. 2, a bare stranded cable portion 10 of an insulated cable 12 is positioned within a metallic connector sleeve 20 which is to be crimped to the end of cable 12. Connector sleeve 20 is tubular and of known diameter, although the size of the connector sleeve is variable dependent upon the particular diameter stranded cable 10 that is chosen. Connector sleeve 20 includes two diametrically co-aligned apertures 21 and 22 formed in connector sleeve 20.

Referring to FIGS. 1 through 4, crimping tool 30 in accordance with the invention comprises a first member 31, a second member 32 and pivot means 33 to allow the cooperating ends of members 31 and 32 to be moved towards one another. The second member 32 includes a crimping portion 34 at one end, against which the conductor sleeve 20 is positioned. The first lever member 31 includes a cooperating crimping portion 35, which will be generally parallel to crimping portion 34 when connector sleeve 20 is properly crimped. The surface length of crimping portions 34 and 35 are preferably longer in length than conductor sleeve 20. In accordance with the invention, piercing portion 36 extending from portion 35 is cylindrical in cross-section and terminates at its free end with a gently sloping conical point 37. A recess 38 is formed in crimping portion 34 to receive the point 37 during the latter phase of the crimping operation.

It is desired to establish a minimum spacing between crimping portions 34 and 35 to avoid splitting conductor sleeve 20 or breaking strands of cable 10 and to obtain flat, parallel surfaces on the exterior of the conductor sleeve 20. A limit buttress portion 42 is formed upon the first lever member 31. An adjustment screw 39 is threadably engaged within a tapped aperture 40 through screw buttress portion 41 and through the second member 32 upon which screw buttress portion 41 is formed. Adjustment screw 39 is rotated into, or out of, tapped aperture 40 to extend an adjustable distance from screw buttress portion 41 such that during a crimping operation the surface **39*a* of adjustment screw 39 will engage the surface 42*a* of limit buttress portion 42 to prevent the application of excessive crimping pressure to connector sleeve 20. By this mechanism, a pair of flat parallel surfaces are provided on sleeve 20** without splitting the connector sleeve or breaking cable strands through overpressure.

In a typical application, connector sleeve 20 is to be crimped to stranded cable 10 and an aligned passage for mounting hardware is to be formed in the stranded cable so as to be aligned with pre-formed apertures 21 and 22. A portion of insulation sleeve 12 is stripped away to expose an end portion of stranded cable 10, which end portion is inserted into the bore of the connector sleeve 20. The adjustment screw 39 is rotated into, or out of, tapped aperture 40 until the distance between surfaces **39*a* and 42*a* of the adjustment screw 39 and the screw buttress 41 are set to a predetermined position, to allow the crimping portions 34 and 35 to press the interior surface of sleeve 20 into intimate engagement with the adjacent strands of cable 10 and form a firm frictional hold. This distance is dependent on, but less than, the diameter D of the stranded cable 10 plus twice the wall thickness T of the connector sleeve 20**.

The ends 34 and 35 of crimping tool 30 are separated so that connector sleeve 20 may be generally positioned against the surface of crimping portion 34 without mechanical interference with point 37. Force is applied to members 31 and 32, at their ends opposite to the crimping portions 35 and 34 respectively, while connector sleeve 20 is rotated about the stranded cable 10 to align point 37 with aperture 21 to enable point 37 to engage the top surface of the stranded cable 10. Force is now firmly applied to move the point 37 of the piercing section 36 through stranded cable 10 and to preferably transversely displace rather than cut through the individual strands of cable 10 thereby forcing them outward into the empty annular space between the interior surface of the loosely fitted connector sleeve 20 and the exterior of the stranded cable 10. Point 37 also passes through connector sleeve aperture 22 and is received within clearance recess 38 while piercing portion 36 fills the formed passage to maintain the configuration of the formed passage while the sleeve and the cable are crimped by tool portions 34 and 35.

Clamping portion 35 now bears on the entire upper exterior surface of the conductor sleeve 20. Continued application of force causes pressures to be transmitted along the entire length of the conductor sleeve 20 by both clamping portions 34 and 35, substantially simultaneously and equally. The applied force deforms conductor sleeve 20 until the limit buttress surface **42*a*** engages surface 39*a* of the adjustment screw 39 and the spacing between clamping portions 34 and 35 is at its desired minimum. The interior surface of connector sleeve 20 has been sufficiently pressed onto the stranded cable 10 and a firm frictional crimp with flat surfaces along the entire exterior length of the connector sleeve is obtained. The members 31 and 32 are now moved apart from one another and the completed connector-wire assembly is removed from the piercing portion 36, which has retained the mounting hardware passage as well as holding the cable strands in their displaced positions to thereby fill the interior volume of the connector sleeve until the crimping operation is completed.

It is also desirable to indicate the magnitude of crimping force applied by crimping portions 34 and 35 to assure that the interior surface of conductor sleeve 20 has been properly pressed onto cable portion 10. A force measurement device 44 used as part of a preferred embodiment of the present invention includes a hollow enclosure 31*a* formed at the end of member 31 aligned with crimping portion 34. A cylindrical member 45 having one end thereof forming cooperating crimping portion 35, with piercing portion 36 extended therefrom, is slidably extended through a first aperture 31*b* formed in the enclosure wall and positioned whereby piercing portion 36 and recess 38 cooperate as described above. A cylindrical indicator shaft 46 axially extends from the center of an annular disc 47, which disc is attached to the free end of member 45 and has a diameter greater than the diameter of aperture 31*b*, to retain member 45 when the crimping tool is not in use. Shaft 46 is slidably extended through a second aperture 31*c* formed in the enclosure wall opposite first aperture 31*b*. A spring 48 biases annular disc 47 toward the enclosure wall having aperture 31*b* formed therethrough. Indicator shaft 46 includes a sequence of force calibration marks 46*a*, the predetermined values of which are dependent upon the spring constant of spring 48 and the length of shaft 46 projecting through aperture 31*c*. In use, crimping portions 34 and 35 are moved toward one another until the predetermined proper one of force calibration marks 46*a* project through aperture 31*c* even with the exterior of enclosure 31*a*, to establish a maximum spacing between crimping portions 34 and 35.

Figure 6:
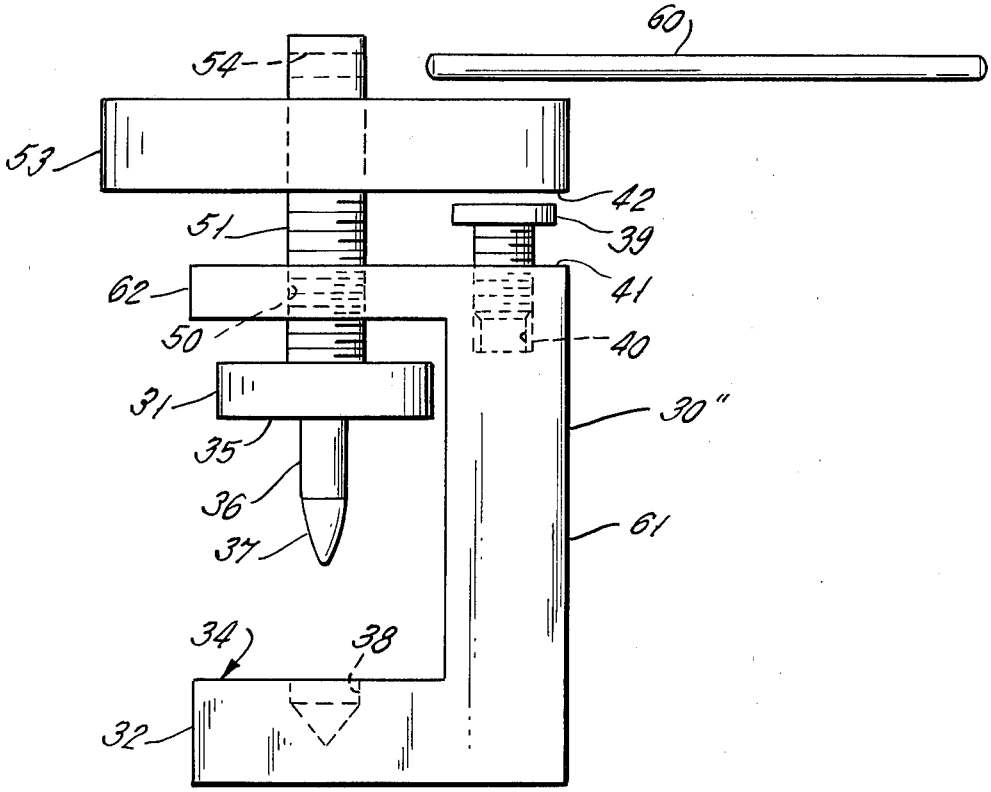
Figure 5:
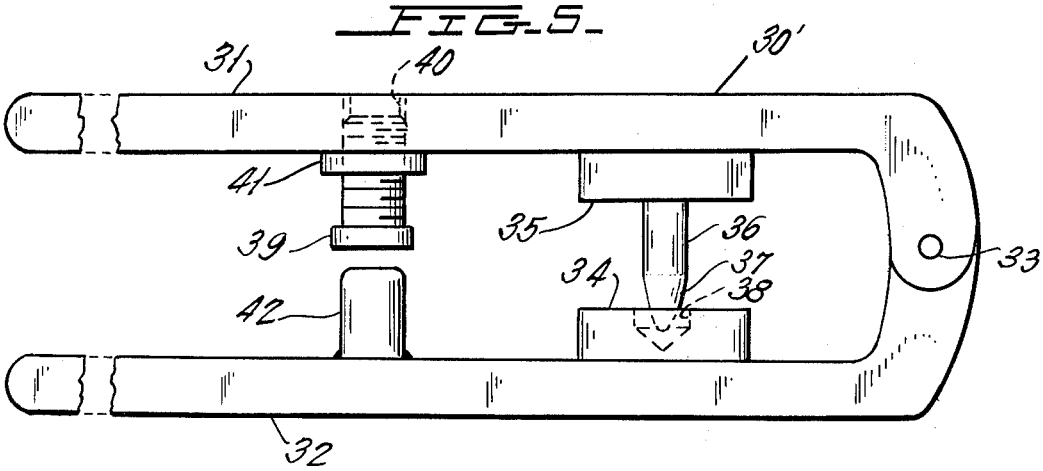

FIGS. 5, 6, and 7 show alternative embodiments 30', 30'' and 30''' of the crimping tool. In the embodiment of FIG. 5, the pivot means 33 has been placed at one end of each of the first and second members 31 and 32 to allow the members to move towards one another and the crimping portions 34 and 35 have been made with a rounded cross-section. The remaining structure is substantially as shown in FIG. 1. In this embodiment, a large mechanical advantage is always achieved. The connector sleeve, with an inserted cable end, may be positioned in the crimping portions 34 and 35 and yet enter the tool in a plane perpendicular to the axis of shaft 36 but at an angle to the members 31 and 32. This embodiment is particularly useful in applications in which a relatively thick cable is being utilized, requiring a large force to be applied to form the passage and to crimp a relatively thick sleeve wall to that cable, or in which the crimping tool must be utilized in a confined space around the cable end, such as the riser trough behind a circuitbreaker panel, in which the tool must be positioned at an angle with respect to the cable direction and force multiplication is required when the tool operator cannot unaidedly generate sufficient force, because of his awkward position.

In the embodiment of FIG. 6, a tool 30'' is shown which uses another means for moving members 31 and 32 towards one another. The pivot means of tools 30 and 30' is replaced by the threaded shaft 51 and tapped aperture 50, extending through the arm 62 of U-shaped member 61. The first member 35 is affixed to shaft 51 and comprises the piercing portion 36 at one end of the first member, joined to the first crimping portion 35. A disc 53 is secured to shaft 51 and a rod opening 54 is diametrically drilled through shaft 51 at a position above the top surface of the disc 53. A rod 60 may be inserted into opening 54. The remaining structure is substantially as shown in FIG. 1. In this embodiment threaded shaft 51 is rotated by manipulation of disc 53 to move the first and second crimping portions toward one another, to pierce the cable and crimp the sleeve. If more crimping force is desired, one end of rod 60 is inserted into the rod opening 54 and the resulting large mechanical advantage multiplies the force applied to the other end of the rod 54. This embodiment is suitable for semipermanent mounting, as in a location where large numbers of cable-connector assemblies are to be formed over a period of time.

In the embodiment of FIG. 7, a crimping tool 30''' uses pneumatic or hydraulic pressure for moving crimping portions 34 and 35 towards one another. U-shaped member 61 includes a first arm 32 having a crimping portion 34 with a recess 38 formed therein. A second arm 62 includes a pressure enclosure 65 in which is mounted a piston 66 having member 31, cooperating crimping portion 35 and piercing portion 36 formed at an end thereof, which end 66*a* is downwardly extended as high pressure gas or fluid is forced into enclosure 65 via pipe 67 connected to a pressure source. Arm 62 contains a recess 62*a*, which recess closely cooperates with piston shaft 66*b* to guide piercing portion 36 along a straight line toward recess 38. Pressure gauge 70 and/or pressure alarm switch 71 are connected to enclosure 65 by tube 72. Pressure switch 71 may be utilized to sound a buzzer or other suitable alarm, or to shut a valve (not shown) in pressure pipe 67, when the desired pressure is reached and the required force has been produced on connector sleeve 20 by crimping portions 34 and 35. This embodiment is suited for permanent mounting, as in a central factory producing very large quantities of cable-connector assemblies.

It can be seen from the foregoing description that the present invention provides a novel crimping tool for use in substantially simultaneously piercing and crimping a connector sleeve and stranded wire, where a passage is formed in the stranded cable and its shape is maintained during application of crimping forces sufficient to distort the entire length of the connector sleeve walls and cause frictional crimp between the entire sleeve and the cable.

Although the present invention has been described in connection with several preferred embodiments thereof, many variations and modifications will now become apparent to those skilled in the art. It is, therefore, preferred that the present invention be limited not by the specific disclosure made herein, but only by the appended claims.

What is claimed is:

1. Apparatus for forming a through connection passage in a stranded cable having a conductive sleeve mounted thereon in a loosely fit fashion, said sleeve being provided with first and second co-aligned openings, said apparatus comprising:

first means for forming a passage through said cable in the region between said co-aligned sleeve openings by displacement of the strands of said cable in a direction transverse to the axis of said sleeve and movement of said displaced strands towards the interior surface of said sleeve, the resulting passage being in alignment with said co-aligned sleeve openings; and crimping means for pressing at least the portions of said sleeve surrounding said sleeve openings towards one another to move said sleeve into intimate engagement with the adjacent strands of said cable, whereby said cable and said sleeves are brought into intimate electrical engagement and the crimped regions surrounding said openings are formed to facilitate mechanical and electrical joining of a terminal thereto;

said first means operatively positioned within the formed passage to prevent collapse thereof during crimping of the sleeve and cable by said crimping means.

2. Apparatus as set forth in claim 1, wherein said crimping means includes clearance means cooperating with said first means for preventing said first means from interfering with the operation of said crimping means.

3. Apparatus as set forth in claim 1, wherein said crimping means further comprises second means for limiting the maximum deformation of said sleeve.

4. Apparatus as set forth in claim 1, wherein said crimping means further comprises third means for indicating the magnitude of a crimping force produced on said sleeve portions by said crimping means.

5. Apparatus as set forth in claim 1, in which the crimping means comprises:

a first member having a first crimping portion thereon;

a second member having a second crimping portion thereon; and means for moving said first and second members toward one another such that said first and second crimping portions press against said sleeve at the regions surrounding said sleeve openings.

6. Apparatus as set forth in claim 5, in which the first means comprises:

a cylindrical shaft attached at one end thereof to said first crimping portion; and a conical point formed at another end of said shaft which engages the cable prior to engagement thereof by said cylindrical shaft.

7. A crimping tool for forming a through passage in a stranded cable having thereon in a loosely fitted fashion a sleeve provided with first and second co-aligned openings, said crimping tool comprising:

a first member having a first crimping portion formed thereon;

a second member having a second crimping portion formed thereon;

a piercing portion extending from said first crimping portion toward said second crimping portion;

a recess communicating with said second crimping portion to receive said piercing portion; and means for moving said first and second crimping portions towards one another, whereby said piercing portion forms a passage through said cable in the region between said co-aligned openings by displacement of the strands of said cable in a direction transverse to the axis of said sleeve and movement of said displaced strands toward the interior surface of said sleeve, the resulting passage being in alignment with said co-aligned sleeve opening and said piercing portion preventing collapse of the passage while first and second crimping portions press portions of said sleeve surrounding said sleeve openings into firm engagement with the adjacent strands of said cable to form a completed crimp.

8. A crimping tool as set forth in claim 7, further comprising means for limiting the minimum distance between said first and second crimping portions.

9. A crimping tool as set forth in claim 8, in which the limiting means comprises:

a first buttress portion on one of said members;

a second buttress portion on the other of said members;

a tapped aperture in said second buttress portion; and an adjustable screw rotatably engaged in said tapped aperture, whereby said first buttress portion is positioned to operatively engage said adjustable screw thereby limiting further approach between said crimping portions to a minimum permissible distance therebetween.

10. A crimping tool as set forth in claim 9, further comprising means for indicating the magnitude of a crimping force produced on said sleeve portions by said first and second crimping portions.

11. A crimping tool as set forth in claim 7, in which the piercing portion comprises:

a cylindrical shaft extended at one end thereof from said first crimping portion; and a conical point attached to said shaft at another end thereof.

12. A crimping tool as set forth in claim 11, in which said first and second crimping portions have generally flat surfaces in a direction generally perpendicular to the axis of said piercing portion.

13. A crimping tool as set forth in claim 12, in which said first and second crimping portions are generally parallel when spaced by the minimum permissible distance.

14. A crimping tool as set forth in claim 13, in which said first and second crimping portions surfaces have lengths at least equal to the axial length of the cable connector against which said surfaces will be pressed.

* * * * *